US006592279B1

(12) United States Patent
Kagel

(10) Patent No.: US 6,592,279 B1
(45) Date of Patent: Jul. 15, 2003

(54) POP-UP PEN

(75) Inventor: David Kagel, Calabasas, CA (US)

(73) Assignee: Perfect Promotional Products, Inc., Oxnard, CA (US)

( * ) Notice: Subject to any disclaimer, the term of this patent is extended or adjusted under 35 U.S.C. 154(b) by 0 days.

(21) Appl. No.: 10/262,293

(22) Filed: Sep. 30, 2002

(51) Int. Cl.[7] ..... B43K 24/02; B43K 5/16; B43K 7/12

(52) U.S. Cl. ..... 401/104; 401/106; 401/99; 401/109; 401/112

(58) Field of Search ..... 401/6, 99, 104–114; D19/51

(56) References Cited

U.S. PATENT DOCUMENTS 2,427,068 A * 9/1947 Randolph ..... 401/106
4,549,827 A * 10/1985 Mack ..... 401/104
5,651,626 A * 7/1997 Chen ..... 401/104

* cited by examiner

*Primary Examiner*—David Walczak
*Assistant Examiner*—Tuan Nguyen
(74) *Attorney, Agent, or Firm*—Lyon & Harr, LLP; Richard T. Lyon; Katrina A. Lyon

(57) ABSTRACT

A pop up writing implement that includes a pump handle, an outer sleeve, an inner pen casing, a spring, a pen cartridge and a connector, which in one embodiment is U-shaped. The pen is expandable and contractible, making it small enough to easily carry in any typical pocket. The design of the pen protects against inadvertent markings, making it unnecessary for it to have a detached pen cap. The pen of the present invention also incorporates no screws, making it immune to screw loosening problems.

4 Claims, 4 Drawing Sheets

POP-UP PEN

BACKGROUND OF THE INVENTION

1. Technical Field

This invention relates to a writing implement, and, more specifically, to an improved collapsible pen.

2. Background Art

Pens, especially ballpoint pens, have long been instrumental to everyday life. They are crucial to the performance of any task that requires a person to write things by hand, especially when this writing should be of a permanent nature. Pens are used, for example, for signing legal documents, taking notes in meetings and lectures, recording medical notes in patient records and writing letters. The typical person cannot imagine life without this simple writing implement.

Since pens are so popular and widely used, pens are often inscribed with advertising material, such as a company's logo or trademark. They are often given away at promotional events and set out for customers to use. This method of advertising is relatively inexpensive and provides wide coverage because a pen is often used by more than one person, or is invariably lost and found by another person.

Since pens are so useful, they are often carried with people where ever they go. This practice, does, however, have some drawbacks. For example, the typical pen is six or seven inches long, which often makes it difficult to comfortably carry in one's pocket. Pens of the typical length so carried will often jab the person carrying the pen. This is particularly true when a person is quite active, such as when performing strenuous physical exercise such as running, or working in the field.

Another disadvantage of the typical pen is that many pens require a cap to prevent them from inadvertently writing on unintended objects or leaking on one's clothing. These pen caps are often lost or separated from the pen, thus making the pen difficult to transport without the risk of ink leaking on one's belongings.

Yet another disadvantage related to prior writing implement designs, is that they are sometimes held together with screws. The screws tend to loosen with use over time, and the pen then falls apart, rendering it useless.

To prevent the common problems and disadvantages of the current pen configurations, an improved pen is required. This improved pen should be small enough to easily transport without injury. Such an improved writing implement would provide major advancements in functionality and practicality over the present technology. It would also prevent the writing instrument's inadvertent marking or writing on unintended objects without the need for an unattached cap. Additionally, such a writing implement should be held together with other than screws to avoid the aforementioned problem of the screw loosening.

SUMMARY

The present invention overcomes the common problems and disadvantages of prior writing implements by a pen that is expandable and contractible, and is small enough to be easily carried in any typical pocket. The design of the pen protects against inadvertent markings, making it unnecessary for it to have a detached pen cap. Furthermore, the pen of the present invention also incorporates no screws, making it immune to screw loosening problems.

The pop up pen of the present invention includes a pump handle with a curved or "hooked" end, an outer sleeve, an inner pen casing, a spring, a pen cartridge and a connector, which in one embodiment is U-shaped. The inner casing has two portions, that are joinable by matching threads.

When the pen is assembled, a protrusion on the pump handle, which has a hole therein, is lined up with two protrusions on the outer sleeve, which also each have holes, so that all of these holes are coaxial and the flat head at the hooked end of the pump handle engages a slot at the end of the pen's inner casing. The connector is then threaded through the holes such that the inner casing is held within the outer sleeve by the hooked end of the pump handle and the U-shaped connector. Before so assembling the pen, the spring is installed within the outer sleeve so that one edge of it rests on a ridge in the interior of the outer sleeve. The assembled inner casing, with the pen cartridge installed in it by inserting it within the inner casing portions and screwing them together, is then installed. Ridges on the outer surface of the inner casing and the interior of the outer sleeve capture the spring between them.

The pen, so assembled, can be extended and contracted to expose and conceal the writing tip of the pen cartridge at the end of the inner casing.

When the pen is in the contracted position, the flat head at the hooked end of the pump handle is engaged in the slot at the end of the inner casing and the length of the pump handle is generally parallel to the outer sleeve. In this position, the spring is fully extended and the writing tip is retracted so that it lies within the outer sleeve.

By grasping the pump handle at the end furthest away from its circular head and pulling it away from the outer sleeve, the circular head of the pump handle slides in the slot of the inner casing, acting as a cam, and extends through a slot of the outer sleeve. The inner casing, acting as a cam follower, slides forward and extends from the outer sleeve, exposing the writing tip of the pen cartridge. The spring is compressed between the ridge in the outer sleeve and the ridge on the inner casing. The pen in this position is ready to be used as a writing implement.

To retract the pen, the end of the pump handle is pivoted back toward the outer sleeve. The spring decompresses and the inner casing is retracted into the outer sleeve. In this retracted position the writing tip of the pen cartridge is within the outer sleeve and in this position the pen will not inadvertently mark on anything.

In an alternate embodiment of the pen of the present invention, the components of the pen are joined by a ring connector, vice a U-connector that is threaded through the holes of the protrusions.

The pen of the present invention is advantageous in that it is small enough to fit in one's pocket, especially when it is in its retracted position. It also does not require a separate pen cap to prevent it from inadvertently marking on anything. Since no screws are used to put together the pen, screw loosening problems are avoided. Furthermore, the outer shell can easily be imprinted with a company name, logo or slogan by conventional methods, so the pen can readily serve as an advertising vehicle.

In addition to the just described benefits, other objectives and advantages of the present invention will become apparent from the detailed description which follows hereinafter when taken in conjunction with the drawing figures which accompany it.

DESCRIPTION OF THE DRAWINGS

The specific features, aspects, and advantages of the present invention will become better understood with regard to the following description, appended claims, and accompanying drawings where:

FIG. 1B(1) is a cross sectional view of one end of the outer sleeve. FIG. 1B(2) is a side view of the outer sleeve of the pen. FIG. 1B(3) is a cross-sectional view of the other end of the outer sleeve.

FIG. 1C(1) is a cross sectional view of one end of the shorter portion of the inner casing. FIG. 1C(2) is a side view of the two inner casing portions of the pen. FIG. 1C(3) is a cross-sectional view of one end of the longer portion of the inner casing.

DETAILED DESCRIPTION OF THE PREFERRED EMBODIMENTS

In the following description of the preferred embodiments of the present invention, reference is made to the accompanying drawings which form a part hereof, and in which is shown by way of illustration specific embodiments in which the invention may be practiced. It is understood that other embodiments may be utilized and structural changes may be made without departing from the scope of the present invention. For example, while the following description is directed toward a surfboard, the structures and process to be described are equally applicable to other water craft.

Figure 1A:
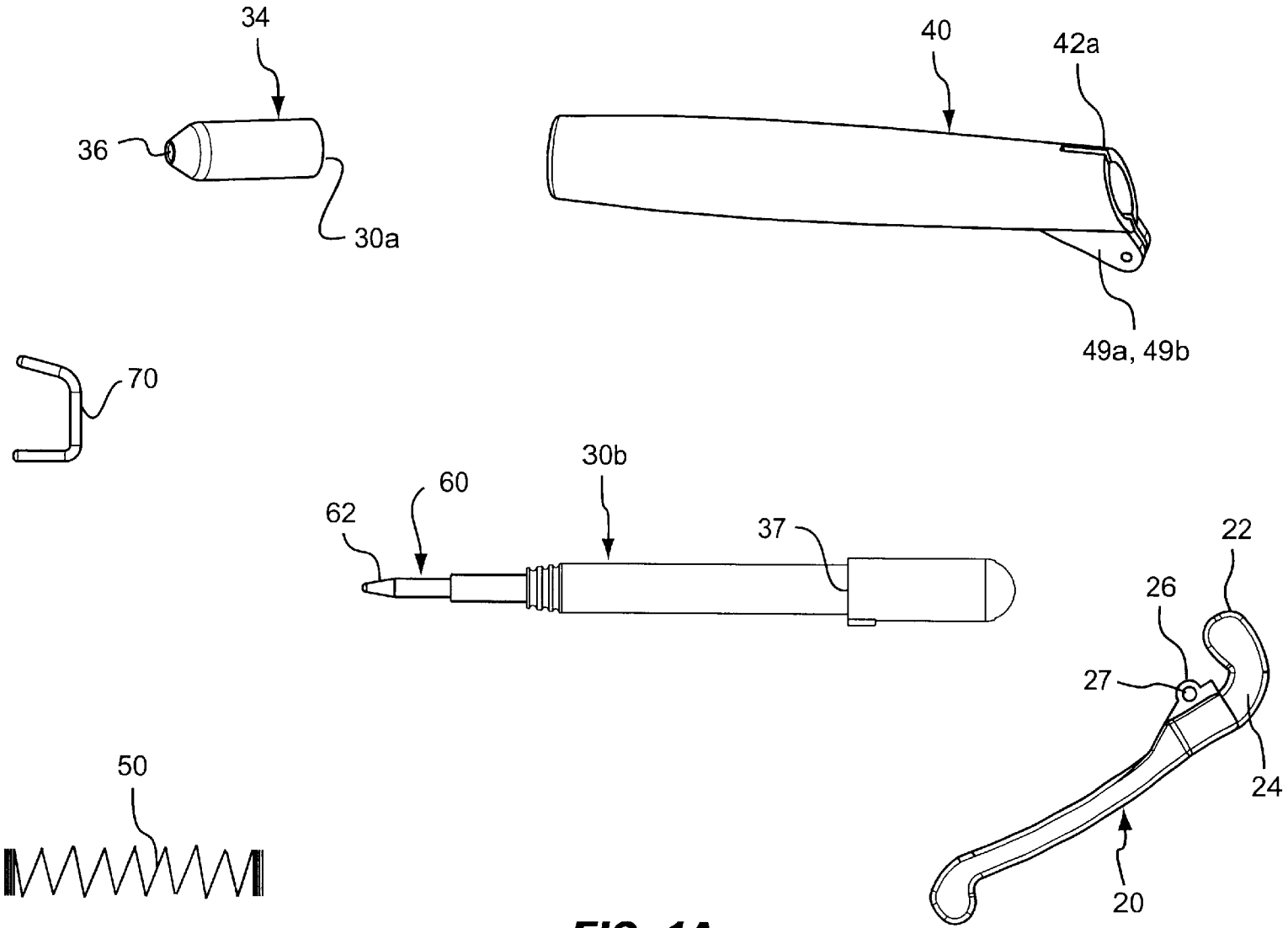
FIG. 1A is an exploded view of the parts of pen of one embodiment of the present invention.

As shown in FIG. 1A, the pop up pen 10 of the present invention includes a pump handle 20, an outer sleeve 40, an inner pen casing 30 comprised of two parts 30*a* and 30*b*, a spring 50, a pen cartridge 60 and connector 70, which in one embodiment is U-shaped as shown.

Figure 1B:
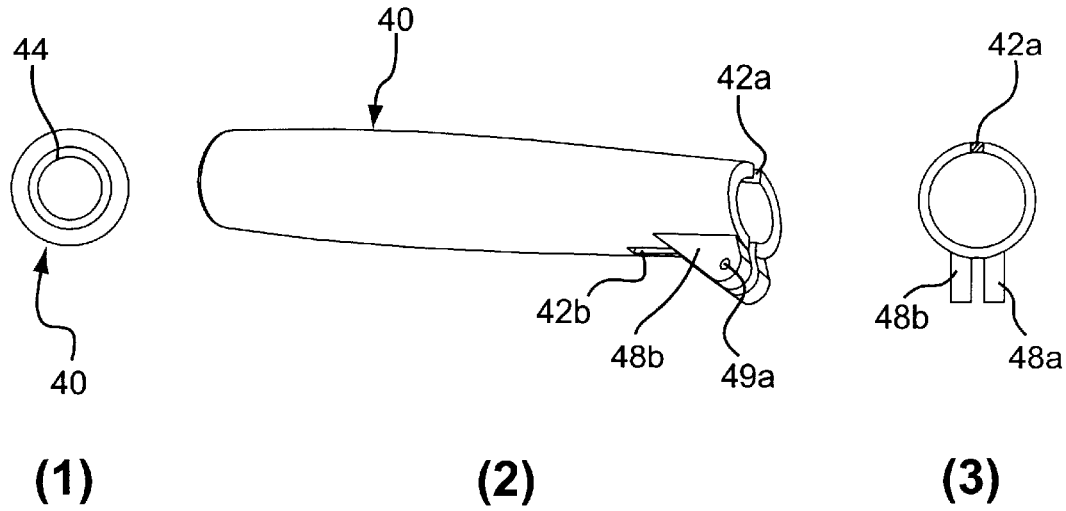
FIG. 1B is a drawing of the outer sleeve of the pen of the present invention.
Figure 1C:
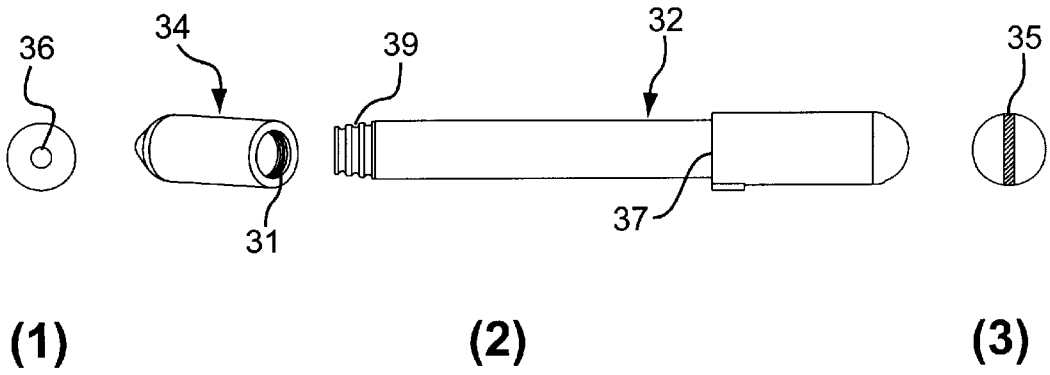
FIG. 1C is a drawing of the inner sleeve of the pen of the present invention.

As shown in FIGS. 1A, 1B and 1C, the outer sleeve 40 is generally cylindrical and hollow for receiving the inner pen casing 30, the spring 50 and the pen cartridge 60. At the first end the outer sleeve 40 there is a slot 42*a* for receiving the upper edge 22 of the pump handle 20. The inner surface of the outer sleeve 40 has a slight ridge 44 around the circumference of the inner surface approximately two thirds of the distance from first end of the outer sleeve 40 having the slot 42*a*. The edge of the first end of the outer sleeve 40 is shaped at a slant. Attached at the outer edge of the first end of the outer sleeve 40, directly opposite slot 42*a*, are two identically shaped protrusions 48*a* and 48*b*, each having a hole 49*a* and 49*b* for receiving a portion of the pump handle 20 and the connector 70. Directly below the protrusions 48*a*, 48*b*, and directly opposite the first slot 42*a*, is another smaller slot 42*b* sized so as to allow the very tip of the hooked end of the pump handle 20 to pass through it.

As shown in FIG. 1C, the inner pen casing 30 comprises two parts, a first longer portion 32 and a second shorter portion 34. Both portions 32, 34 are generally cylindrical, hollow and shaped for receiving the pen cartridge 60. The first longer portion 32 is closed at one end with the exception of having a slot 35 cut vertically therein for receiving the edge of the flat, hook shaped head 24 of the pump handle 20. The first portion of the pen's inner casing 34 also has a ridge 37 around it, approximately a quarter of its length from the first closed end. The second end of the first longer portion 32 is threaded. The threads 39 are configured so as to mate with threads 31 of the second shorter portion 34 of the pen's inner casing 30. The end opposite the threads 31 of the shorter portion's 34 has a hole 36 for receiving the tip of the pen cartridge 60.

The pump handle 20 has a flat, hook shaped head 24, as mentioned previously. This flat head 24 is shaped so as to fit into the slot 35 of the first longer portion of the pen inner casing 30. The lower surface of the pump handle 20 has a protrusion 26 with a hole 27 therein.

When the pen 10 is assembled, the pump handle's protrusion 26 is lined up with the protrusions on the outer sleeve so that all holes 27, 49*a*, 49*b* are coaxial and the flat head 24 of the pump handle 20 engages the slot 35 in the pen's inner casing 30. The connector 70 is then threaded through the holes 27, 49*a*, 49*b* such that the inner casing 30 is held within the outer sleeve 40 by the pump handle 20 and the connector 70. Before so assembling the pen 10, the spring 50 is installed within the outer sleeve 40 so that one edge of it rests on the ridge 44. The assembled inner casing 30, with the pen cartridge 60 installed in it by inserting it within the inner casing 30 portions 30*a* and 30*b* and screwing the threaded ends together, is then installed. The ridges 37 and 44 capture the spring 50 between them.

Figure 2:
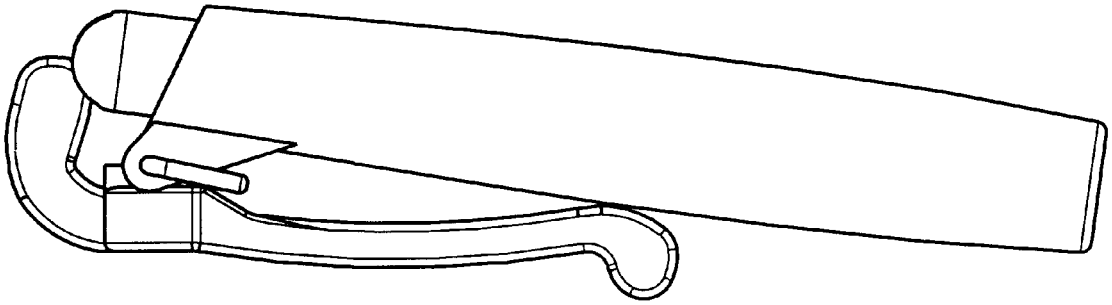
FIG. 2 is an assembled view of the pen of the present invention in the contracted position.
Figure 3:
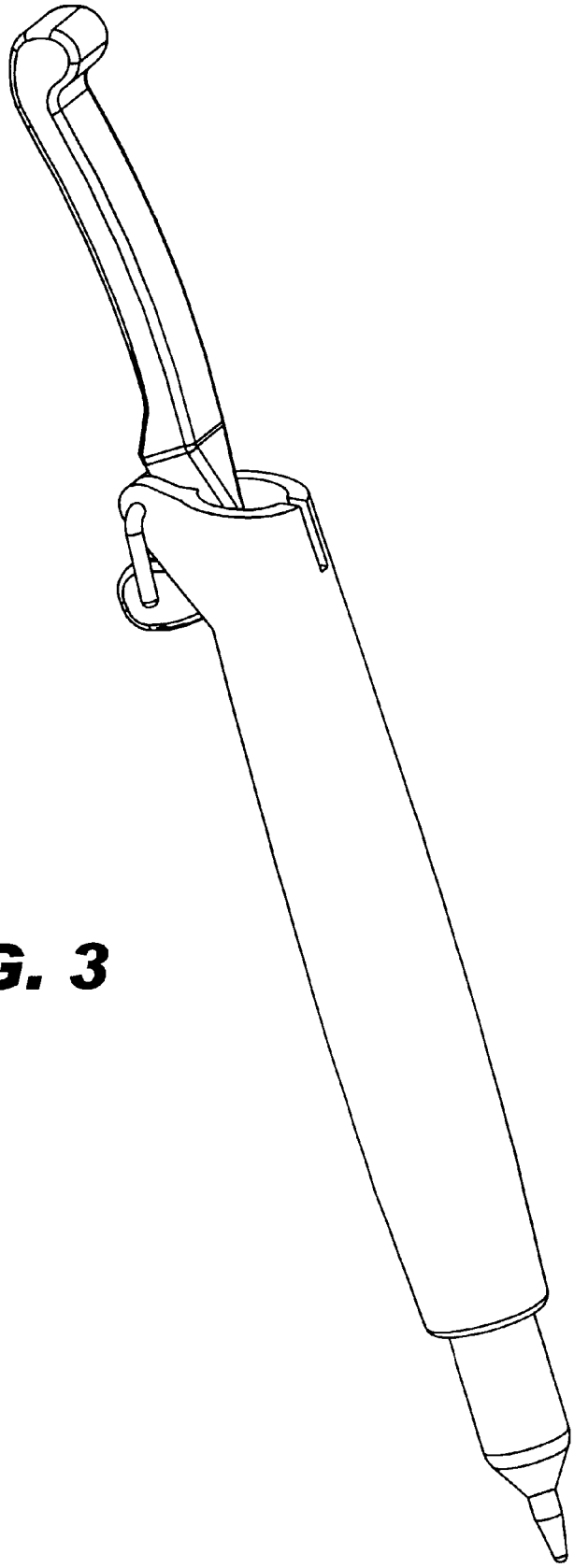
FIG. 3 is an assembled view of the pen of the presented invention in the expanded position.

The pen, so assembled, can be extended and contracted to expose and conceal the writing tip 62 of the pen cartridge 60 at the end of the inner casing 30. The contracted pen is shown in FIG. 2. The extended pen is shown in FIG. 3.

When the pen 10 is the contracted position the very tip of the curved head of the pump handle 20 is engaged in the slot 35 of the inner casing 30 and the length of the pump handle 20 is generally parallel to the outer sleeve 40. In this position, the spring is fully extended and the writing tip is retracted so that it lies within the outer sleeve.

By grasping the pump handle 20 at the end furthest away from its circular head and pulling it away from the outer sleeve 40, the circular head of the pump handle 20 slides in the slot 35 of the inner casing 30, acting as a cam, and extends through slot 42*b* of the outer sleeve. The inner casing 30, acting as a cam follower, slides forward and extends from the outer sleeve 40, exposing the writing tip 62 of the pen cartridge 60. The spring 50 is compressed between the ridge 44 in the outer sleeve and the ridge 37 on the inner casing 34*a*. The pen 10 in this position is ready to be used as a writing implement.

To retract the pen 10, the end of the pump handle 20 is pivoted toward the outer sleeve 40. The spring 50 decompresses and the inner casing 30 is retracted into the outer sleeve 40. In this retracted position the writing tip 62 of the pen cartridge 60 is within the outer sleeve 40 and in this position the pen 10 will not inadvertently mark on anything.

It should be noted that other embodiments of the invention can use a connector other than a U-shaped connector, such as a ring-shaped connector that is placed through the holes 27, 49*a* and 49*b* to hold the pump handle 20, outer sleeve 40 and inner casing 30 in proper operating position. Another connector that can be used is a pin or other device wherein the ends are larger than the holes 27, 49*a* and 49*b* in the protrusions extending from the outer sleeve. Any such connector that is placed through these holes to hold the pieces, and that is not a screw mechanism, is advantageous in that it will not be susceptible to coming apart due to loosening of the screw or screws holding it together.

Furthermore, the pen of the present invention is advantageous in that it is small enough to fit in one's pocket, especially when it is in its retracted position. One embodiment of the pen in its contracted position is approximately three inches long. The pen of the invention also does not require a separate pen cap to prevent it from inadvertently marking on anything, since when the pen's writing tip is retracted into the outer casing when the pen is in a collapsed state. Furthermore, because of these aforementioned advantages the pen makes a great vehicle for advertising. The outer shell can easily be imprinted with a company name, logo or slogan by conventional methods.

While the invention has been described in detail by specific reference to preferred embodiments thereof, it is understood that variations and modifications thereof may be made without departing from the true spirit and scope of the invention.

Wherefore, having thus described the present invention, what is claimed is:

1. A writing implement assembly comprising:

an inner casing having a writing implement cartridge contained therein and protruding from a first end thereof;

a hollow outer sleeve having two open ends and containing the inner casing and a spring connected between the inner casing and the outer sleeve so as to bias the inner casing within the outer sleeve such that when in a retracted mode the second end of the inner casing extends out of the first open end of the outer sleeve and the first end of the inner casing with the writing implement cartridge protruding there from being retracted into the second open end of the outer sleeve, said outer sleeve comprising two protrusions extending from the periphery of the outer sleeve, each having a coaxially aligned hole;

a handle having a curved head at one end and a protrusion adjacent said head with a hole therethrough, and an elongated portion extending away from the head, wherein the outer periphery of the curved head is in contact with the second end of the inner casing and wherein the holes in the protrusions of the outer casing are in coaxial alignment with the hole in the protrusion of the handle, and wherein in said retracted mode the elongated portion of the handle extends substantially parallel to the outer sleeve toward the second open end of the outer sleeve; and a non-screw connector which passes through the holes in the protrusions of the outer sleeve and the hole in the protrusion of the handle, said connector being configured so as to be permanently held in place within said holes, and wherein said connector acts as a pivot such that when the elongated portion of the handle is rotated about the connector so as to extend substantially away from the first open end of the outer sleeve, said curved head rotating against the second end of the inner casing so as to push the inner casing in relation to the outer sleeve such that the first end of the inner casing with the writing implement cartridge extending therefrom protrudes out of the second open end of the outer sleeve.

2. The writing implement of claim 1 wherein said connector is U-shaped.

3. The writing implement of claim 1 wherein said connector is ring-shaped.

4. The writing implement of claim 1 wherein the connector has flattened ends, said ends being larger than said holes in the protrusions extending from the outer sleeve.

* * * * *